US008657615B2

(12) United States Patent
Sun

(10) Patent No.: US 8,657,615 B2
(45) Date of Patent: Feb. 25, 2014

(54) LAMP TUBE SOCKET WITH A METAL CLIP BETWEEN A COVERING PORTION AND AN ACTUATING PORTION

(76) Inventor: Ming-Hai Sun, Hsinchu (TW)

( * ) Notice: Subject to any disclaimer, the term of this patent is extended or adjusted under 35 U.S.C. 154(b) by 43 days.

(21) Appl. No.: 13/543,859

(22) Filed: Jul. 8, 2012

(65) Prior Publication Data

US 2013/0033880 A1 Feb. 7, 2013

(30) Foreign Application Priority Data

Aug. 2, 2011 (TW) ..... 100214203 U
Aug. 2, 2011 (TW) ..... 100214204 U

(51) Int. Cl.
*H01R 33/02* (2006.01)

(52) U.S. Cl.
USPC ..... 439/239

(58) Field of Classification Search
USPC ..... 439/226–244; 362/382
See application file for complete search history.

(56) References Cited

U.S. PATENT DOCUMENTS 3,771,106 A * 11/1973 Matsumoto et al. ..... 439/23
5,030,125 A * 7/1991 Toma et al. ..... 439/226
5,855,487 A * 1/1999 Kunishi ..... 439/232
6,561,828 B2 * 5/2003 Henrici et al. ..... 439/239
6,692,309 B1 * 2/2004 Kovacs ..... 439/699.2
6,733,316 B1 * 5/2004 Chen ..... 439/232
6,869,298 B2 * 3/2005 Latsis ..... 439/157
7,896,666 B2 * 3/2011 Tung et al. ..... 439/141
8,475,189 B2 * 7/2013 Sun ..... 439/233
8,475,190 B2 * 7/2013 Sun ..... 439/233
2010/0173534 A1 * 7/2010 Tung et al. ..... 439/733.1
2013/0157492 A1 * 6/2013 Sun ..... 439/240

* cited by examiner

*Primary Examiner* — Chandrika Prasad

(74) *Attorney, Agent, or Firm* — Muncy, Geissler, Olds & Lowe, P.C.

(57) ABSTRACT

A lamp tube socket structure includes a base, an elastic element, an abutting element, a cover and a metal clip, and the base has an actuating portion, a support pillar extended transversally from the actuating portion and comprised of two wings, and an elastic element is contained in the support pillar, and the abutting element is passed and installed to the two wings of the support pillar and pushed by the elastic element, and the cover has a covering portion, an embedding hole formed on the covering portion, and the cover is combined with the base, and a metal clip containing portion is formed between the covering portion and the actuating portion.

5 Claims, 11 Drawing Sheets

LAMP TUBE SOCKET WITH A METAL CLIP BETWEEN A COVERING PORTION AND AN ACTUATING PORTION

FIELD OF THE INVENTION

The present invention relates to a lamp tube socket structure, more particularly to the lamp tube socket structure capable of preventing a lamp tube from falling out easily.

BACKGROUND OF THE INVENTION

With reference to FIG. 11 for the structure of a conventional lamp tube socket 91, the conventional lamp tube socket 91 has a longitudinal plug hole 910, and a metal clip 911 installed in the plug hole 911. To install a lamp tube 92, a terminal 920 at an end of the lamp tube 92 is plugged longitudinally into the plug hole 910 of the lamp tube socket 91, so that the terminal 920 is contained in the plug hole 910 of the lamp tube socket 91, and then the lamp tube 92 is turned to rotate the terminal 920 by 90 degrees, so that the terminal 920 is clamped by and electrically coupled to the metal clip 911 to achieve the effects of connecting to a power supply and positioning the lamp tube 92.

When there is an earthquake, the lamp tube 92 may be shaken transversally, and the terminal 920 of the lamp tube 92 may slide and separate from the clamp of the metal clip 91, since the terminal 920 of the lamp tube 92 is clamped sideway by the metal clip 911 only. Thus, the lamp tube 92 may fall out and cause accidents.

SUMMARY OF THE INVENTION

In view of the drawbacks of the prior art, it is a primary objective of the present invention to overcome the aforementioned drawbacks by providing a lamp tube socket structure, wherein a lamp base has an abutting element pushed by an elastic element, such that when a lamp tube is installed in a lamp tube socket, a metal clip installed in the lamp tube socket is provided for clamping the lamp tube. In addition, an abutting element is provided for clamping and fixing the lamp tube, so that the lamp tube can be fixed onto the lamp tube socket normally. If there is an earthquake, the stroke of the elastic element abutting the abutting element provides a bugger for the sideway slide of the lamp tube to prevent the lamp tube on the lamp base from sliding out of the lamp tube socket, so as to prevent the lamp tube from falling out or causing injuries or accidents.

To achieve the aforementioned objective, the present invention provides a lamp tube socket structure comprising: a base, comprised of at least one first plugging portion, an actuating portion extended upwardly from the base, a support pillar transversally extended from the actuating portion, and two wings disposed opposite to each other on the support pillar; an elastic element, contained in the support pillar, and having an end protruded out from the support pillar; an abutting element, passed to the support pillar, and abutted by an end of the support pillar to protrude out of the elastic element; a cover, having at least one second plugging portion, a covering portion extended upwardly from the cover, and a longitudinal embedding hole formed on the covering portion, and the cover being combined with the base by engaging the second plugging portion with the first plugging portion, and the covering portion and the actuating portion are engaged to form a containing portion, and a metal clip is installed in the containing portion.

Wherein, the covering portion of the cover has a penetrating hole, and a rotating element is pivotally coupled to the penetrating hole of the covering portion, and the rotating element has a plug hole communicated with the embedding hole, and the rotating element and the abutting element abut against each other to push the abutting element outwardly.

Wherein, each wing of the support pillar is protruded outwardly from a top end of the wing, and a positioning portion is disposed on both sides of an inner periphery of the plug hole separately, and the two positioning portions are blocked and fixed by the stop portion at the top end of each wing, and each of the positioning portions has a guide section disposed on both sides of the positioning portion separately and provided for guiding the stop portion of each wing and the two positioning portions to press against each other during the rotation.

Preferably, the abutting element is in a disc-shape, and the abutting element has two through holes corresponding to the wings for passing the wing respectively.

DESCRIPTION OF THE PREFERRED EMBODIMENTS

Figure 1:
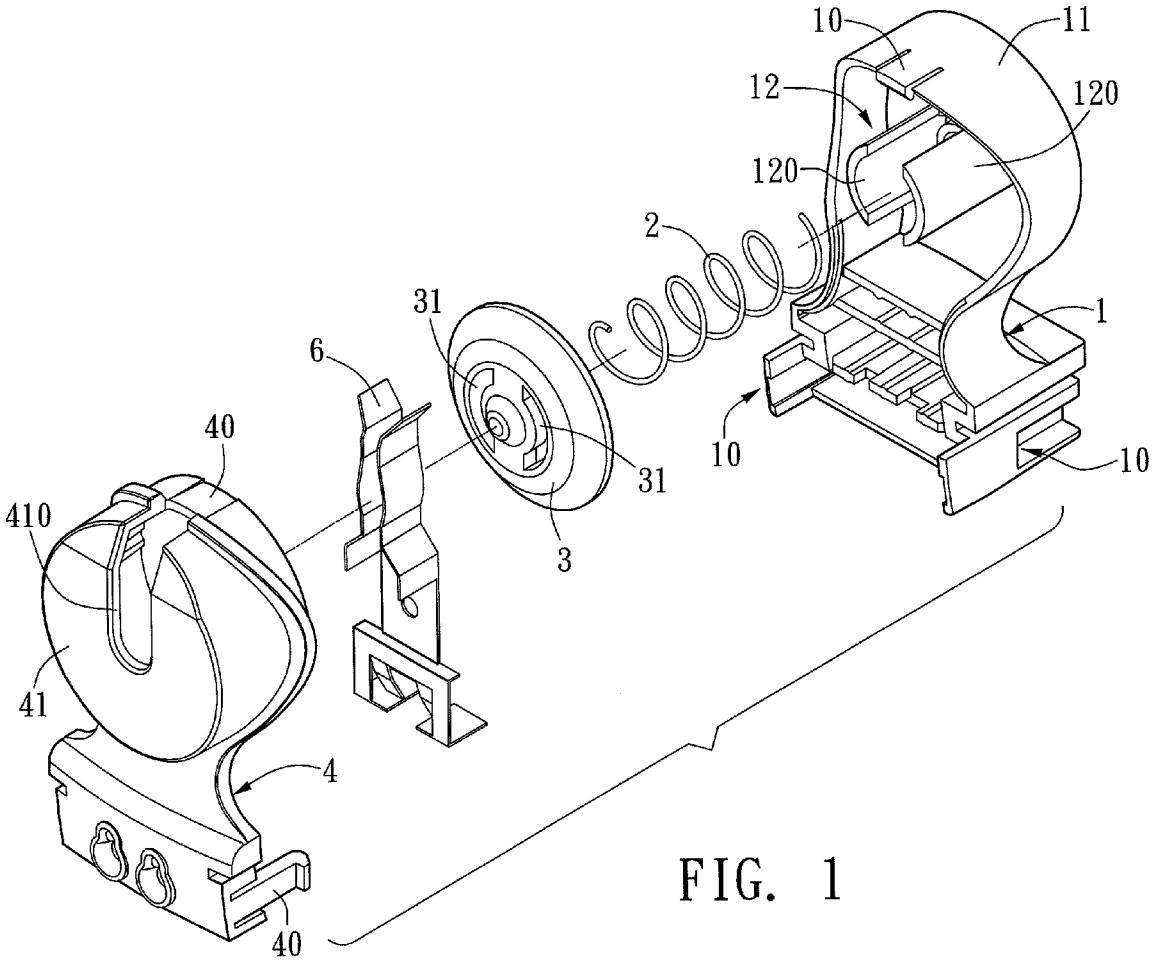
FIG. 1 is a perspective exploded view of the present invention.

With reference to FIGS. 1 to 4 for a lamp tube socket structure in accordance with a first preferred embodiment of the present invention, the lamp tube socket structure comprises: a base 1, an elastic element 2, an abutting element 3, a cover 4, a containing portion 5 and a metal clip 6.

Figure 2:
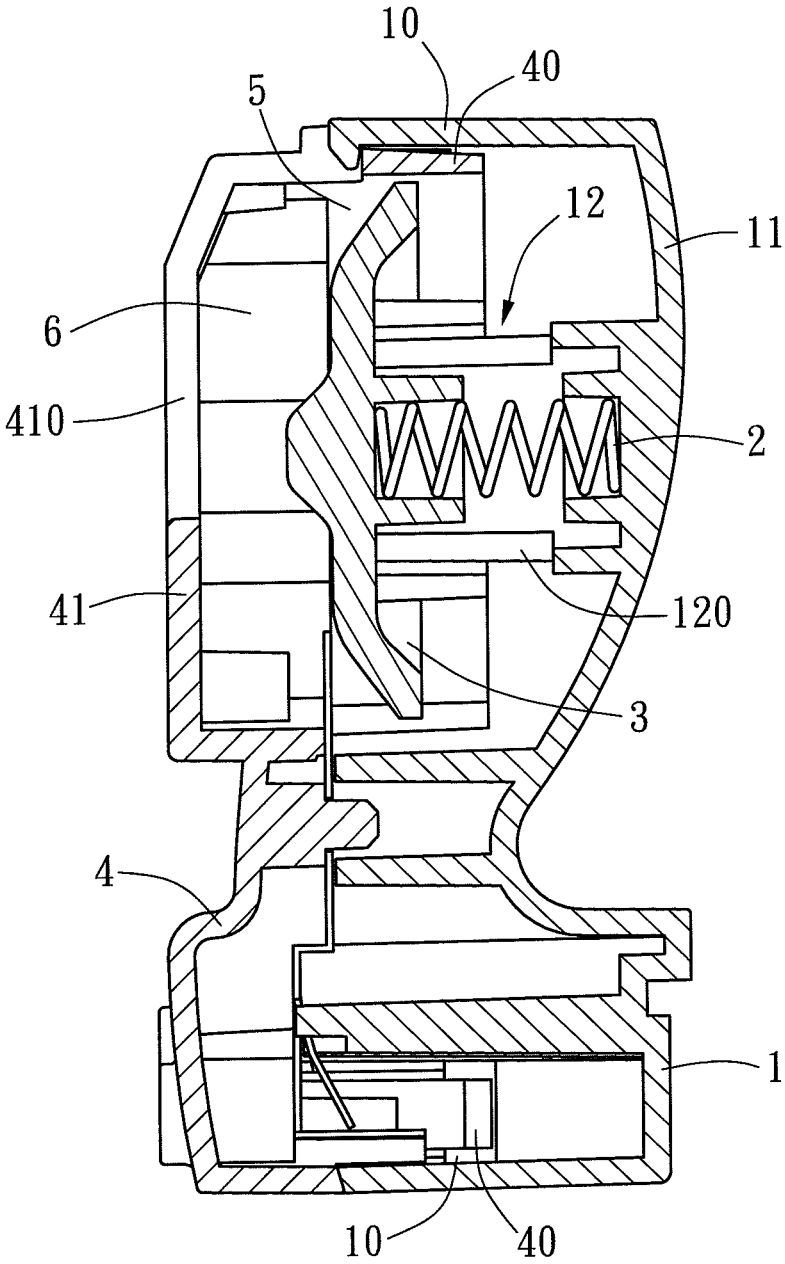
FIG. 2 is a cross-sectional view of the present invention.

In FIGS. 1 and 2, the base 1 includes a first plugging portion 10 disposed on both sides of the bottom of the base 1 separately, an actuating portion 11 extended upwardly from the base 1, another first plugging portion 10 disposed at the top of the actuating portion 11, and a hollow support pillar 12 transversally extended from the actuating portion 11 and comprised of two wings 120, wherein the two wings 120 are disposed opposite to each other.

The elastic element 2 is contained and installed in the support pillar 12. In other words, the elastic element 2 is contained and installed between the two wings 120, and an end of the elastic element 2 abuts the bottom of the support pillar 12, and the other end is protruded out of the support pillar 12.

The abutting element 3 is substantially in a disc-shape, and the abutting element 3 has two through holes 31 corresponding to the wings 120 and provided for passing the wings 120 respectively, and an end of the support pillar 12 protruded out of the elastic element 2 presses against the bottom of the abutting element 3.

In addition, the cover 4 has a second plugging portion 40 disposed on both sides of the bottom of the cover 4 separately, a covering portion 41 extended upwardly from the cover 4, another second plugging portion 40 disposed at a top end of the covering portion 41, and a longitudinal embedding hole 410 formed on the covering portion 41, wherein both sides of the bottom of the cover 4 and the second plugging portion 40 at the top of the covering portion 41 are coupled to the first plugging portions 10 of the base 1 and the base 1 respectively, so that the covering portion 41 and the actuating portion 11 are engaged to form the containing portion 5. The containing portion 5 is a chamber, and a metal clip 6 is installed in the containing portion 5, and a portion of the metal clip 6 corresponding to the embedding hole 410 is exposed from the embedding hole 410. In addition, the abutting element 3 is pushed by the elastic element 2, and the abutting element 3 is blocked by the bottom of the metal clip 6 to limit the stroke of the pushing action.

Figure 3:
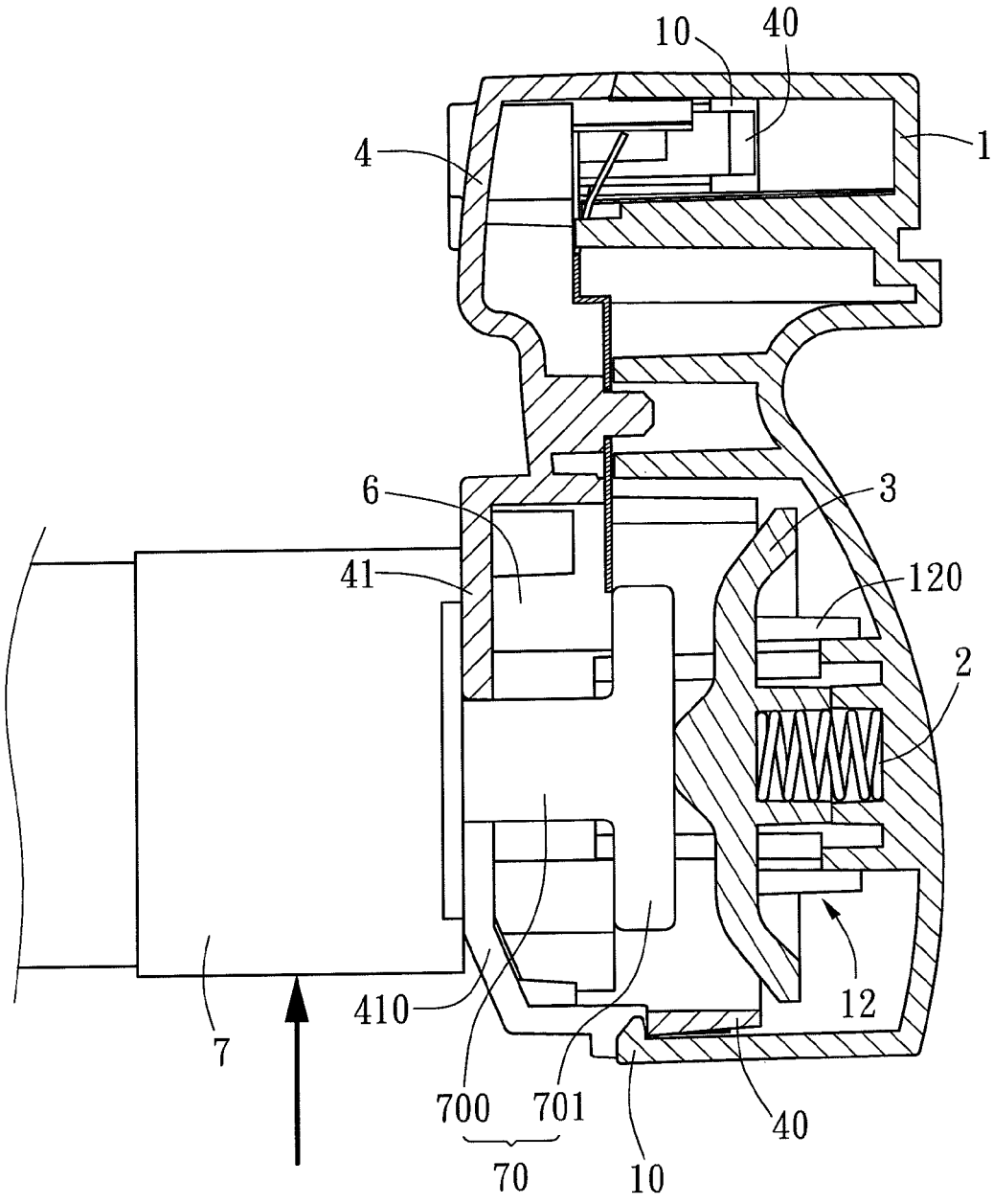
FIG. 3 is a schematic view of a T-shape section clamped between an elastic element and a metal clip in accordance with the present invention.
Figure 4:
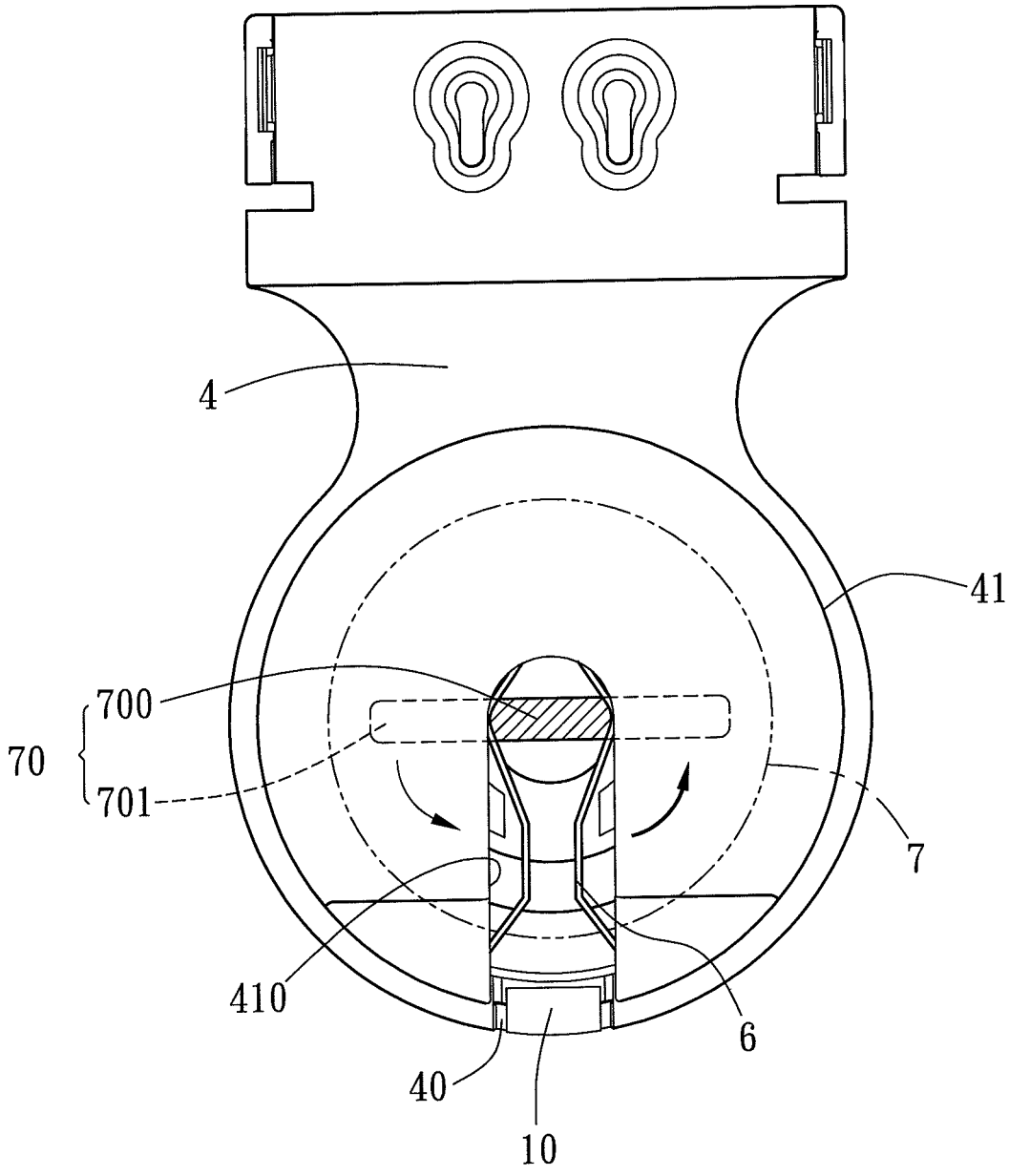
FIG. 4 is a schematic view of a T-shape section rotated by 90 degrees and then fixed into a position in accordance with the present invention.
Figure 5:
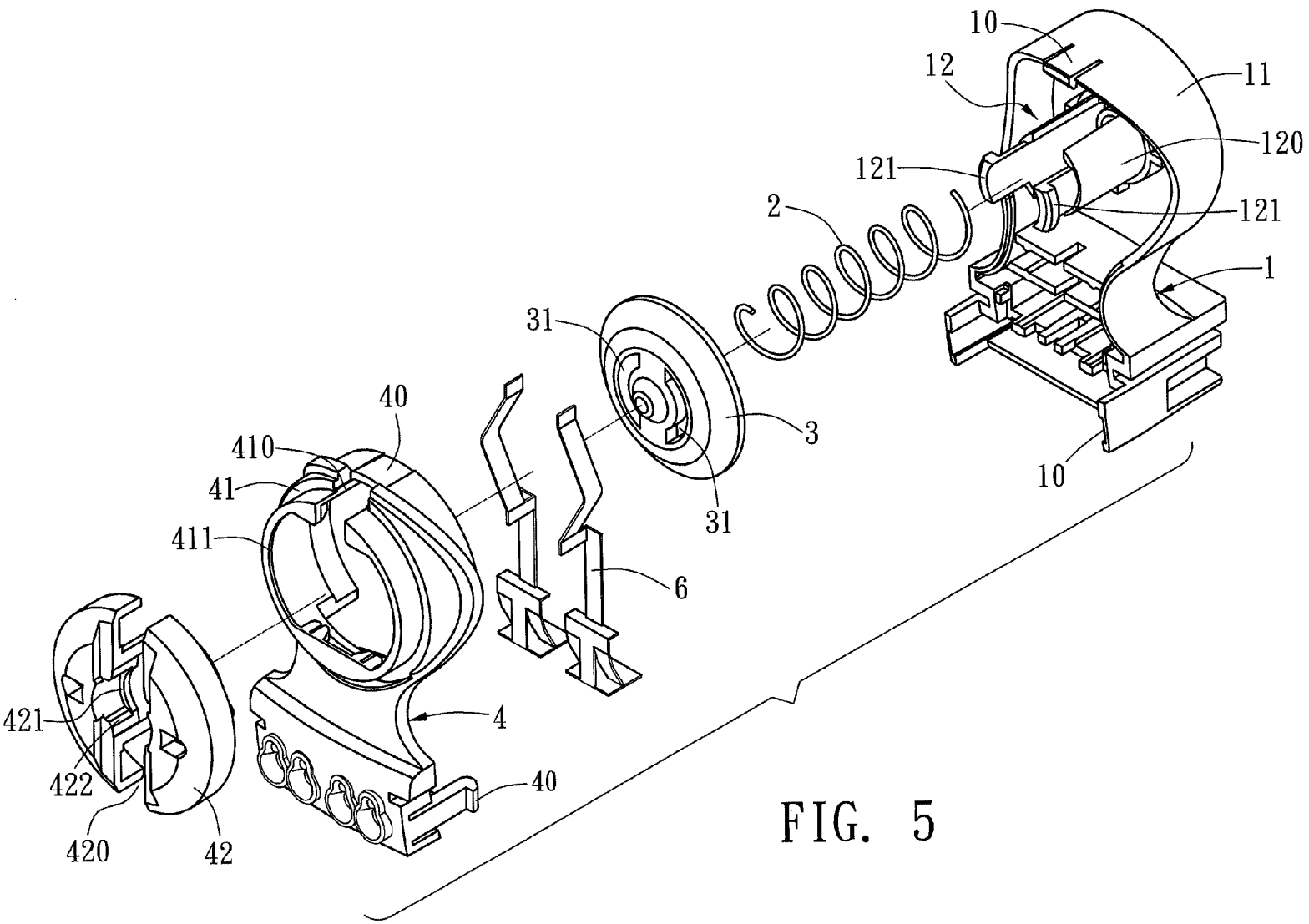
FIG. 5 is another perspective exploded view of the present invention.
Figure 6:
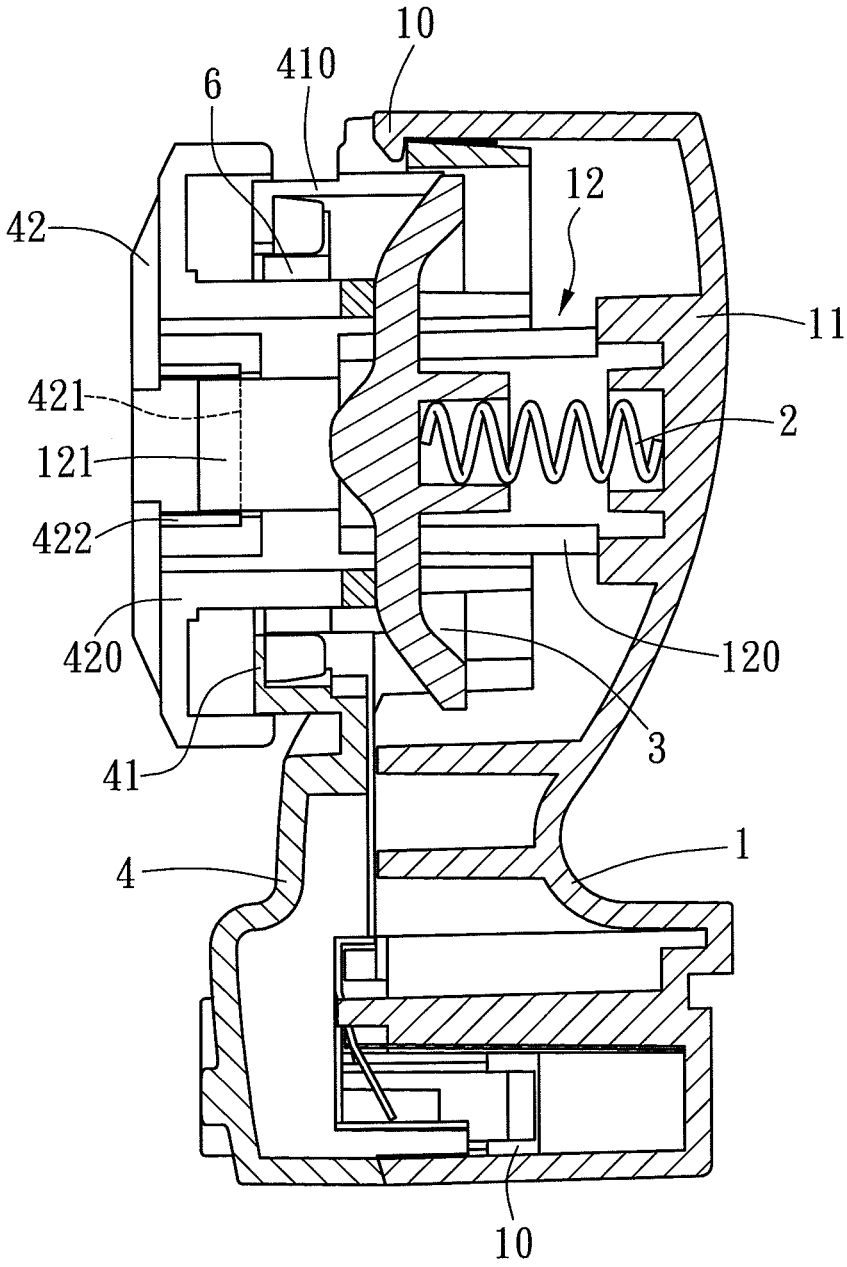
FIG. 6 is another cross-sectional view of the present invention.

The lamp tube socket structure of the first preferred embodiment of the present invention is applied to a lamp tube as shown in FIG. 3, and an end of the lamp tube socket structure is coupled to a T-shape section 70, and the T-shape section 70 includes a retracting section 700 protruded outwardly from an end of a lamp tube 7 and an external convex section 701 extended sideway from the retracting section 700. If the lamp tube 7 is installed to the lamp tube socket structure of the first preferred embodiment of the present invention, the T-shape section 70 is slid longitudinally from an end of the embedding hole 410, and the external convex section 701 presses the abutting element 3 inwardly. Now, the retracting section 700 of the T-shape section 70 is situated at the position of the metal clip 6 in the embedding hole 410, and then the lamp tube 7 is rotated by 90degrees as shown in FIG. 4, so that the original longitudinal external convex section 701 is rotated to a transverse direction. Now, the retracting section 700 is clamped by the metal clip 6, and the external convex section 701 is contained in the containing portion 5 and pushed towards the bottom of the metal clip 6 by the abutting element 3, so that the external convex section 701 is clamped between the metal clip 6 and the abutting element 3. If there is an earthquake, the lamp tube 7 is still clamped by the elastic element 2 and the metal clip 6 in the T-shape section in the containing portion 5, so as to assure the T-shape section at an end of the lamp tube 7 is fixed into the socket and prevent injuries or accidents caused by the falling out of the lamp tube 7.

With reference to FIGS. 5 to 10 for a second preferred embodiment of the present invention, the differences of the second preferred embodiment from the first preferred embodiment are described below:

The embedding hole 410 of the covering portion 41 is formed on a side of the covering portion 41, and a penetrating hole 411 is formed axially on the covering portion 41, and a rotating element 42 is pivotally coupled to the penetrating hole 411 of the covering portion 41, and the rotating element 42 has a plug hole 420 extended longitudinally and communicated with the embedding hole 410, and the rotating element 42 and the abutting element 3 press against each other to push the abutting element 3 outwardly.

Further, each wing 120 of the support pillar 12 has a stop portion 121 outwardly protruded from the top of the wing 120, and a positioning portion 421 is disposed on both sides of the inner periphery of the plug hole 420 separately, and the two positioning portions 421 are blocked and fixed by the stop portions 121 at the top of the wings 120 respectively, and a concavely recessed guide section 422 is disposed on both sides of each positioning portion 421 separately, and each guide section 422 is provided for guiding the stop portion 121 of each wing 120 and the two positioning portions 421 to press against one another when the rotating element 42 rotates. Since the rotating element 42 is pushed outwardly by the abutting element 3, therefore when the rotating element 42 is pressed, the rotating element 42 is retracted in a direction towards the covering portion 41 of the cover 4, and when the pressing on the rotating element 42 is released, the rotating element 42 is pushed outwardly by the abutting element 3 and popped out to resume its original position.

Figure 7:
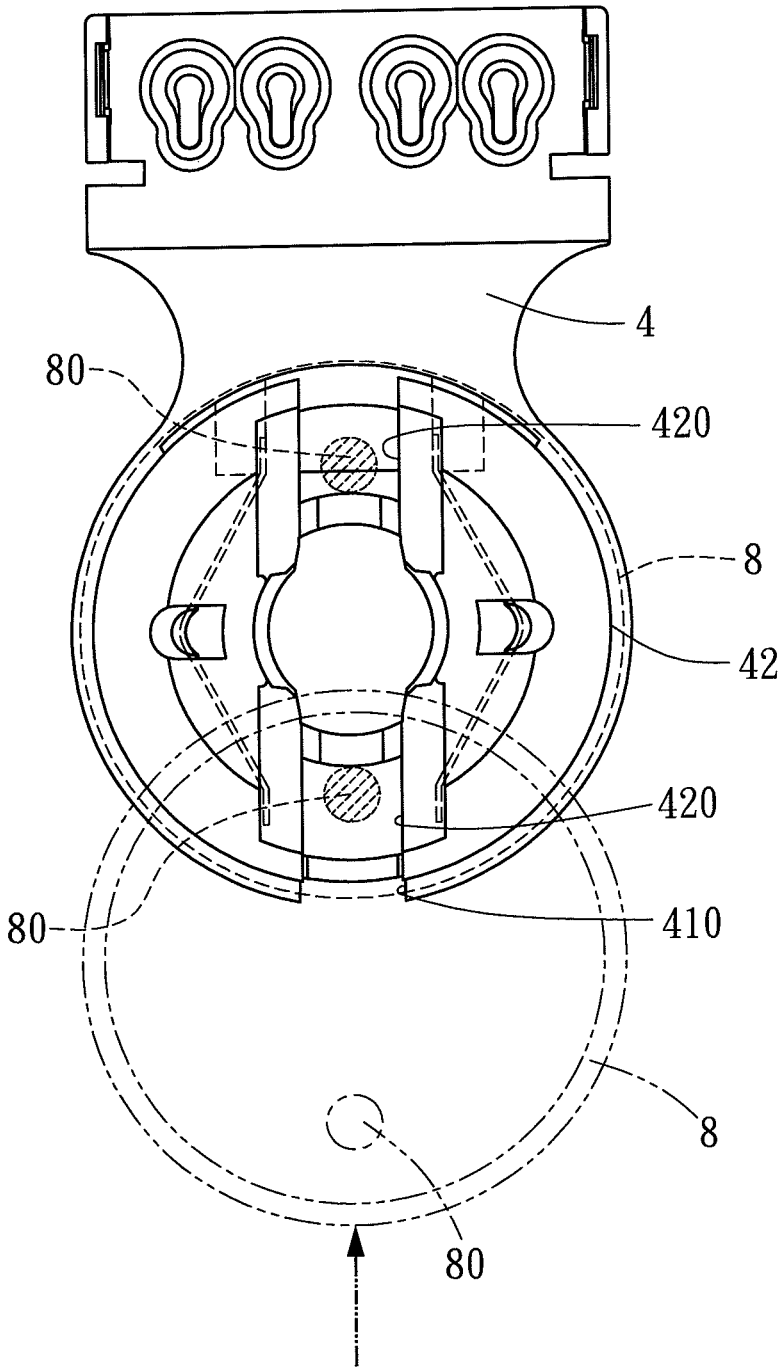
FIG. 7 is a schematic view, showing the action of plugging two terminals of a lamp tube longitudinally into an embedding hole in accordance with the present invention.
Figure 8:
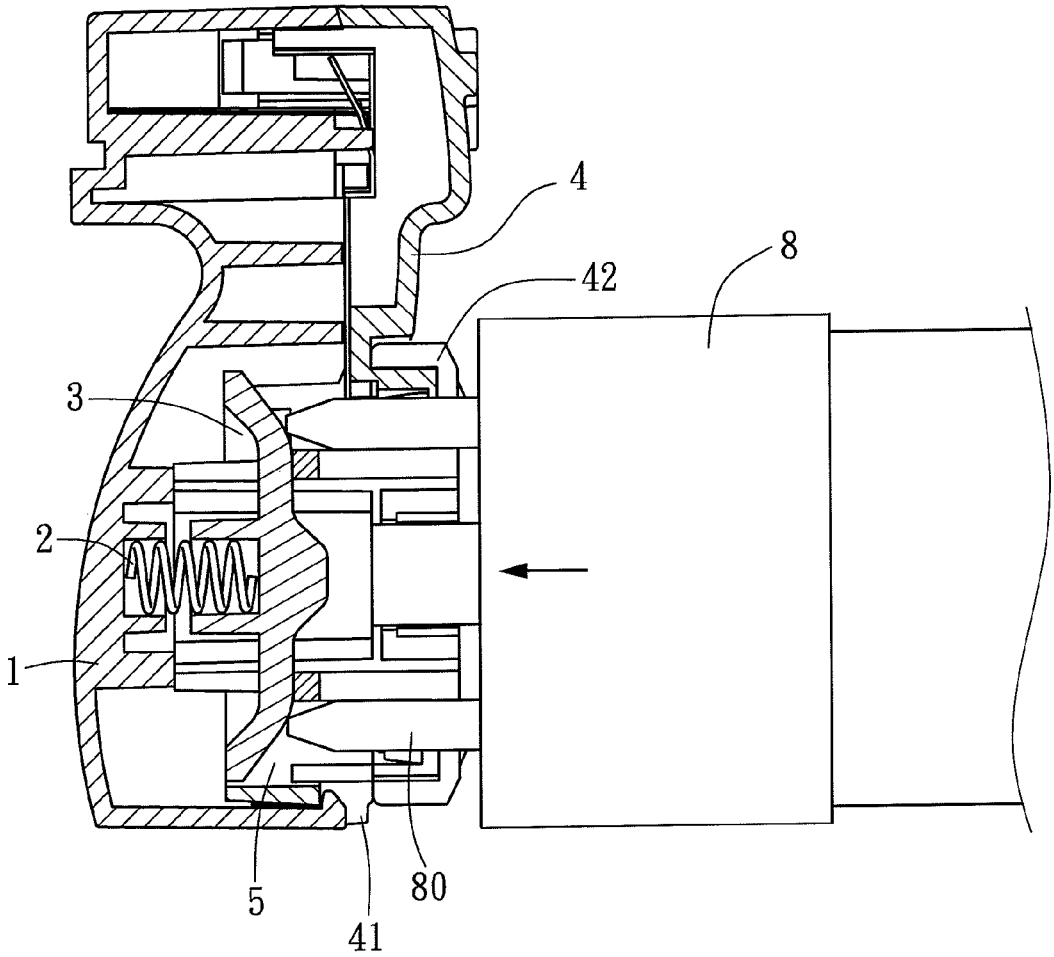
FIG. 8 is a cross-sectional view of a rotating element being pushed by an end of the lamp tube and retracted, and two terminals being extended into the containing portion in accordance with the present invention.
Figure 9:
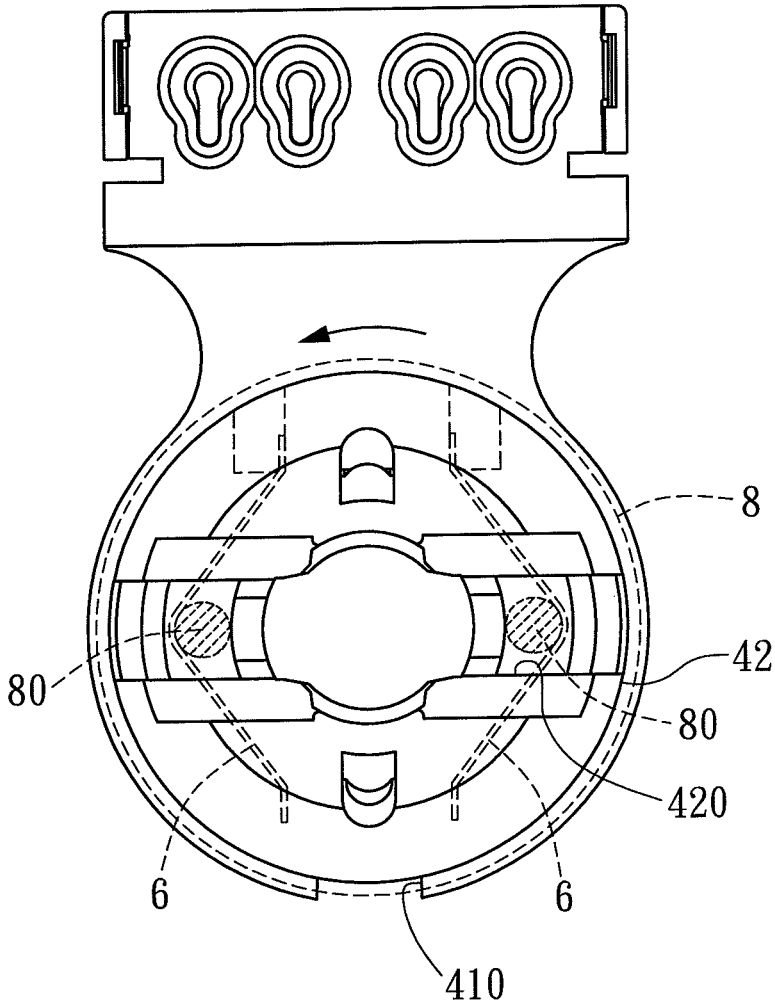
FIG. 9 is a schematic view showing the action of rotating two terminals of a lamp tube by 90 degrees into a fixed position to electrically connect the two terminals to a metal clip in accordance with the present invention.

In FIG. 7, a lamp tube 8 is installed to a socket structure of the second preferred embodiment of the present invention, wherein two terminals 80 at both ends of the lamp tube 8 are slid longitudinally into the embedding hole 410 and the plug hole 420 as shown in FIG. 8, and both end surfaces of the lamp tube 8 support the corresponding rotating element 42, so that the two rotating elements 42 are retracted in a direction towards the covering portion 41 of the cover 4 as shown in FIG. 9. By rotating the lamp tube 8, the two terminals 80 drive the rotating element 42 to rotate by 90 degrees, and the two terminals 80 can electrically connect the metal clip 6 in the containing portion 5, and the two terminals 80 are clamped by the metal clip 6.

Figure 10:
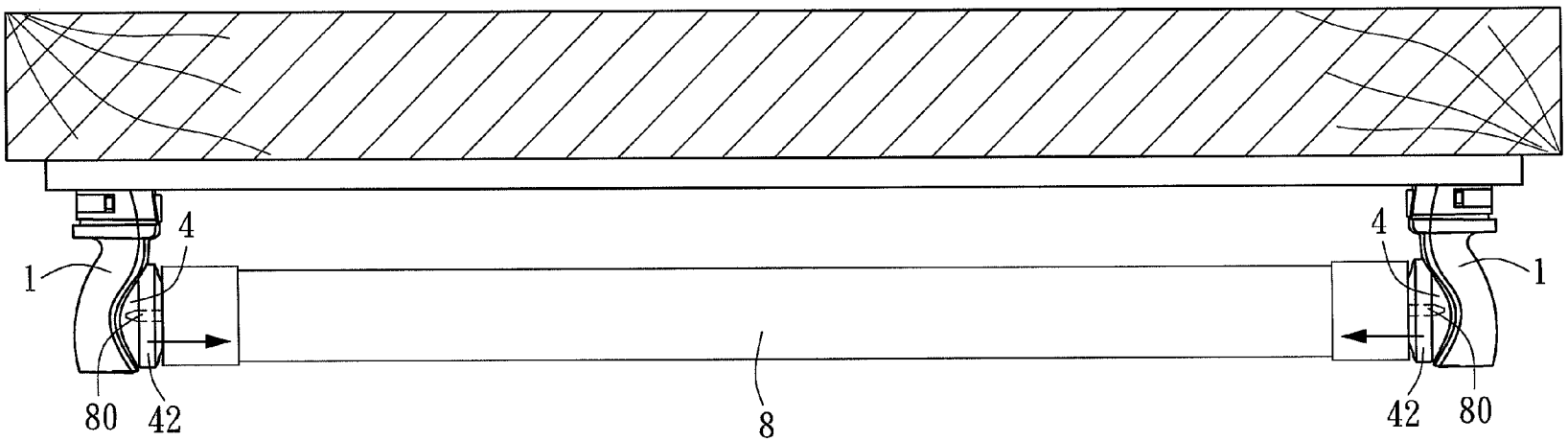
FIG. 10 is a schematic view of a lamp tube being fixed between sockets in accordance with the present invention.
Figure 11:
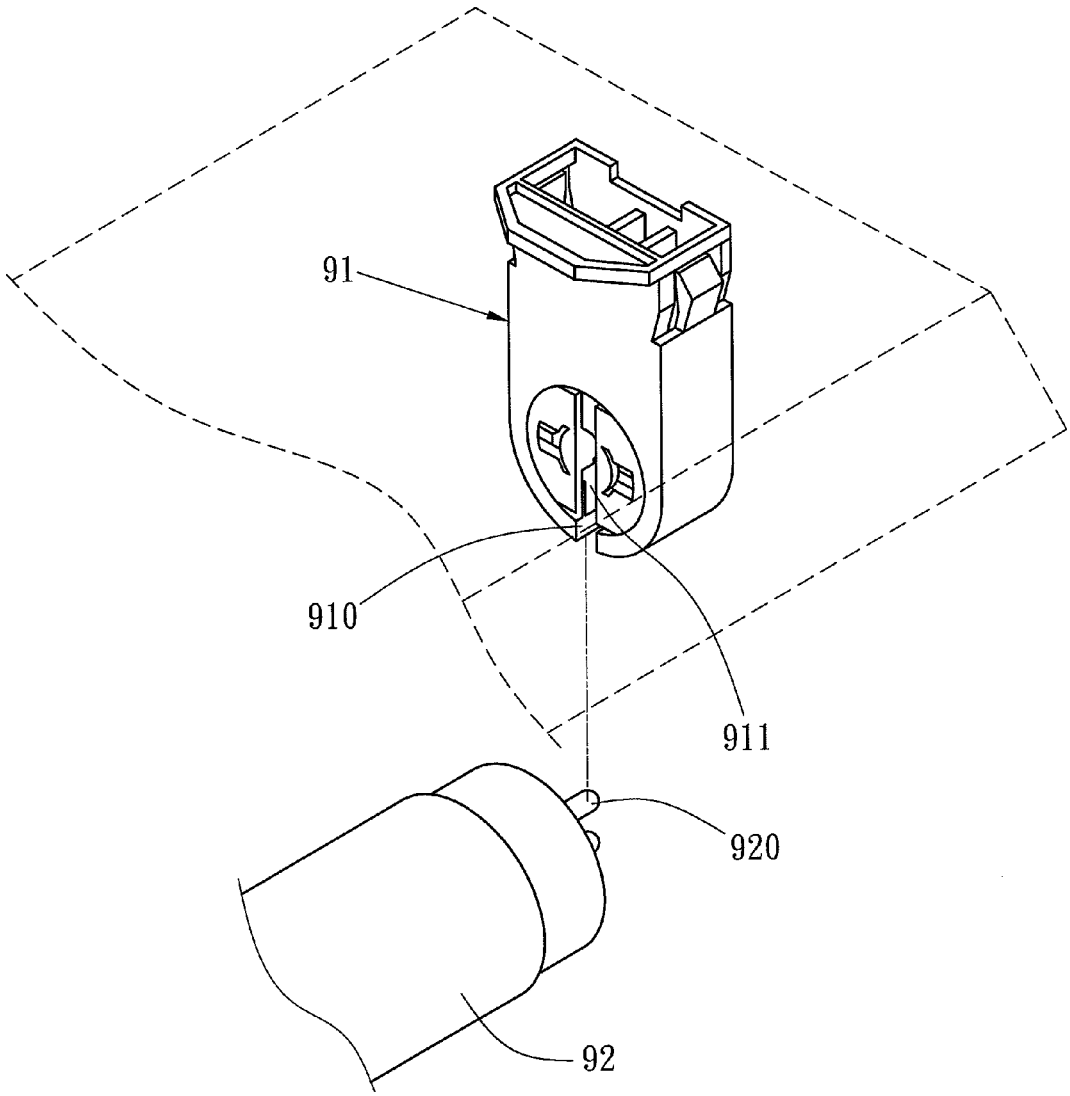
FIG. 11 PRIOR ART
FIG. 11 is a schematic view of the structure of a conventional lamp tube socket.

In FIG. 10, both distal surfaces of the lamp tube 8 are pushed by the outwardly elastic forces of the two rotating elements 42 respectively to achieve the effect of clamping the lamp tube 8. When there is an earthquake, both sides of the lamp tube 8 are still pushed by the rotating element 42 and secured between the two sockets. Even if the lamp base is deformed to increase the gap of each socket, the stroke of popping each rotating element 42 keeps the two terminals 80 at both ends of the lamp tube 8 being clamped by the metal elastic plate 6 and electrically coupled. The invention can prevent the lamp tube 8 from detaching or falling out from the two sockets to prevent accidents or injuries caused by the falling out of the lamp tube 8.

What is claimed is:

1. A lamp tube socket structure, comprising:

a base, comprised of at least one first plugging portion, an actuating portion extended upwardly from the base, a support pillar transversally extended from the actuating portion, and two wings disposed opposite to each other on the support pillar;

an elastic element, contained in the support pillar, and having an end protruded out from the support pillar;

an abutting element, connecting the support pillar, and abutted by an end of the support pillar;

a cover, having at least one second plugging portion, a covering portion extended upwardly from the cover, and a longitudinal embedding hole formed on the covering portion, and the cover being combined with the base by engaging the second plugging portion with the first plugging portion, and the covering portion and the actuating portion are engaged to form a containing portion, and a metal clip is installed in the containing portion.

2. The lamp tube socket structure of claim 1, wherein the abutting element is substantially in a disc-shape, and the abutting element has two through holes corresponding to the wings for passing the wing respectively.

3. The lamp tube socket structure of claim 1, wherein the covering portion of the cover has a penetrating hole, and a rotating element is pivotally coupled to the penetrating hole of the covering portion, and the rotating element has a plug hole communicated with the embedding hole, and the rotating element and the abutting element abut against each other to push the abutting element outwardly.

4. The lamp tube socket structure of claim 3, wherein each wing of the support pillar is protruded outwardly from a top end of the wing, and a positioning portion is disposed on both sides of an inner periphery of the plug hole separately, and the two positioning portions are blocked and fixed by the stop portion at the top end of each wing, and each of the positioning portions has a guide section disposed on both sides of the positioning portion separately and provided for guiding the stop portion of each wing and the two positioning portions to press against each other during the rotation.

5. The lamp tube socket structure of claim 3, wherein the abutting element is substantially in a disc-shape, and the abutting element has two through holes corresponding to the wings for passing the wing respectively.

* * * * *